US006422401B1

(12) United States Patent
Roten

(10) Patent No.: US 6,422,401 B1
(45) Date of Patent: Jul. 23, 2002

(54) HAT STORAGE AND FASHIONING RACK

(76) Inventor: Randal E. Roten, 3304 Buck Run Trail, Wake Forest, NC (US) 27587

( * ) Notice: Subject to any disclaimer, the term of this patent is extended or adjusted under 35 U.S.C. 154(b) by 0 days.

(21) Appl. No.: 09/611,711

(22) Filed: Jul. 6, 2000

(51) Int. Cl.[7] ..... A47F 7/06
(52) U.S. Cl. ..... 211/32; 223/84
(58) Field of Search ..... 211/30–33, 70.6, 211/60.1, 85.18, 85.19, 85.21–85.23, 85.7, 85.3, 89.01, 71.01, 75; 223/1, 84–85, 24–26; 248/318, 121; 206/303, 449, 335, 446, 8–9; 2/209.13, 244, 195.1, 175.1, 195.5, 175.4–175.5; 24/26–33; D6/315, 326–328

(56) References Cited

U.S. PATENT DOCUMENTS

| | | | | | |
|---|---|---|---|---|---|
| 2,494,487 | A | * | 1/1950 | Pfeil | 211/30 |
| 2,783,895 | A | * | 3/1957 | Lynch | 211/30 |
| 3,023,891 | A | * | 3/1962 | Sutter | |
| 3,710,997 | A | * | 1/1973 | Asikainen | 211/60.1 |
| 4,205,629 | A | * | 6/1980 | Wix | 211/75 |
| 4,679,695 | A | * | 7/1987 | Leff | 211/71.01 |
| 4,805,782 | A | * | 2/1989 | Hale et al. | 211/30 |
| 4,927,063 | A | | 5/1990 | Fricano | 223/84 |
| 5,188,325 | A | * | 2/1993 | Hilty et al. | 211/30 |
| 5,480,073 | A | | 1/1996 | LaManna | 223/1 |
| D368,806 | S | | 4/1996 | Sparaco | D6/317 |
| 5,685,465 | A | | 11/1997 | Berardis | 223/84 |
| 5,727,694 | A | | 3/1998 | Larson | 211/33 |
| 5,727,701 | A | * | 3/1998 | Rhoades | 211/70.6 |
| 5,758,779 | A | | 6/1998 | Atkins | 211/32 |
| 5,862,522 | A | | 1/1999 | Cho | 2/195.1 |
| 5,967,387 | A | * | 10/1999 | Bakhtiar | 223/84 |
| 5,991,927 | A | | 11/1999 | Barbaccia | 2/209.13 |
| 6,047,837 | A | * | 4/2000 | Kessens | 211/85.21 |
| D436,752 | S | * | 1/2001 | Mueller | D6/315 |

* cited by examiner

*Primary Examiner*—Alvin Chin-Shue
*Assistant Examiner*—Jennifer E. Novosad
(74) *Attorney, Agent, or Firm*—Mills Law Firm PLLC

(57) ABSTRACT

A hat storage and fashioning rack includes tubular sleeves for housing and supporting the outer surface of the brim in a manner that fashions the hat by gradually imparting a permanent curvature to the brim. The sleeves are carried on a mounting base that may be attached to convenient mounting surfaces such as walls, door closets and the like enabling display, storage and access to the hats. The curvature is effected by gradually relaxing the brim into conformity with the sleeve thereby imparting a permanent set to the brim and overcoming the memory tendency of the brim material to return to the original manufactured shape. After attaining the desired shape, the contour remains notwithstanding use or storage in other locations.

12 Claims, 5 Drawing Sheets

HAT STORAGE AND FASHIONING RACK

FIELD OF THE INVENTION

The present invention relates to the storage devices for hats and, in particular, a storage unit for storing and fashioning the brims of baseball-type hats.

BACKGROUND OF THE INVENTION

Soft-cap, hard-brim hats or caps are widely used for a variety of sporting and leisure activities. In addition to providing protection against adverse weather elements, the caps provide identification for sporting teams, businesses, fashion lines, noted events and other pursuits wherein utilitarian, promotional and fashion statements are connoted with the wearing and collecting of such articles.

Such hats are typified by a stitched, multi-panel cap of a flexible fabric material conforming to the head of the wearer, and a forwardly projecting pointed brim formed of a cloth covered, limitedly flexible material. As purchased, the brims of such hats are generally planar and assume varying curvatures depending on the physical characteristics of the wearer. In an effort to enhance the perceived appearance of the hat or to personalize the wearing thereof, many hat owners have undertaken to manually reshape the hat brims to their individual desires. This reshaping is generally accomplished by gradually manually manipulating the brim until the desired curvature is attained. While oftentimes successful, the manual shaping is tedious and subjects the brim to accelerated wear. Moreover, frequent restyling is necessary, following washing or use for example, inasmuch as the brim tends to return to its manufactured condition.

In an effort to overcome the rigors of manually forming the brim, a number of approaches have been suggested in the prior art. In U.S. Pat. No. 5,862,522 to Cho it was proposed to incorporate into the original manufacture of the cap a steaming and heat drying process to preform the brim to an increased curvature. This thermal forming process was suited for materials not typical of the various commercially available cap designs. Moreover, the preformed curvature is altered under normal wearing conditions. Further, the curvature was preset thereby limiting the general appeal.

U.S. Pat. No. 5,685,465 to Beradis discloses a hat rack having a plurality of double sided, curved brim molds. The hat brims are inserted into mold slots for forming. The device does not account for different brim thickness and exposes the brim to excessive wear. A similar approach is disclosed in U.S. Pat. No. 5,991,927 to Barbaccia wherein the bill is inserted into a single, free standing, double sided shaping device. U.S. Pat. No. 5,480,073 to LaManna discloses a wall or door mounted double sided clip for holding and displaying unformed hats.

U.S. Design Pat. No. D 368,806 to Sparaco discloses a hat bill cupping device using a strap for curving the brim of a hat. The strap spans only a portion of the brim and accordingly may not produce uniform results over the entire brim.

U.S. Pat. No. 5,758,779 to Atkins discloses a hat holder wherein hat brims are supported within apertures in a projecting shelf. The brims are rolled into overlapping relation prior to insertion at the shelf. Only a narrow portion of the brim is restrained. The resulting cap brim may be excessively rolled for the wearer' desires and formed only in the narrow regions of the shelf. A further holder for conventionally formed hat brims is disclosed in U.S. Pat. No. 5,727,694 to Larson wherein the hat brims are flexibly retained in a vertical and circumferential array of elongated slots.

Based on the foregoing limitations it would be desirable to provide a unit for storing, displaying and fashioning the brims of baseball type caps that will allow the wearer to establish a desired uniform curvature to the brim without destruction or undue wear to the brim, and in a manner that maintains the desired curvature during subsequent wearing.

Accordingly, it is an object of the present invention to provide a hat rack for holding, displaying and providing curvature to hard brimmed hats.

Another object of the invention is to provide a method for distinctively forming the brim of a baseball type hat in a convenient, non-destructive manner.

A further object of the invention is to provide a hat storage rack wherein a plurality of hats may be conveniently stored while undergoing shaping of the brim to a desired curvature.

Yet another object of the invention is to provide a baseball hat storage rack that may be conveniently mounted on a visible, accessible surface for storing and displaying a number of hats in a manner that safely imparts and maintains a desired contour for the hat brims.

BRIEF SUMMARY OF THE INVENTION

The present invention accomplishes the above and other objectives by providing a storage rack having a plurality of elongated tubular sleeves for housing and supporting only the outer surface of the brim in a manner that fashions the hat by gradually imparting a permanent curvature to the brim. The sleeves are carried on a mounting base that may be attached to convenient mounting surfaces such as walls, door closets and the like enabling convenient display, storage and access to the hats. The curvature is effected by gradually relaxing the brim into conformity with the inner cylindrical surface of the sleeve through controlled engagement with a substantial portion of the brim thereby imparting a fill curvature thereto. This relaxation imparts a permanent set to the brim overcoming the memory tendency of the brim material to return to the original manufactured shape. After attaining the desired shape, the contour remains notwithstanding use or storage in other locations. There is accordingly provided an effective storage and brim fashioning rack for hard billed hat brims.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENT

Figure 1:
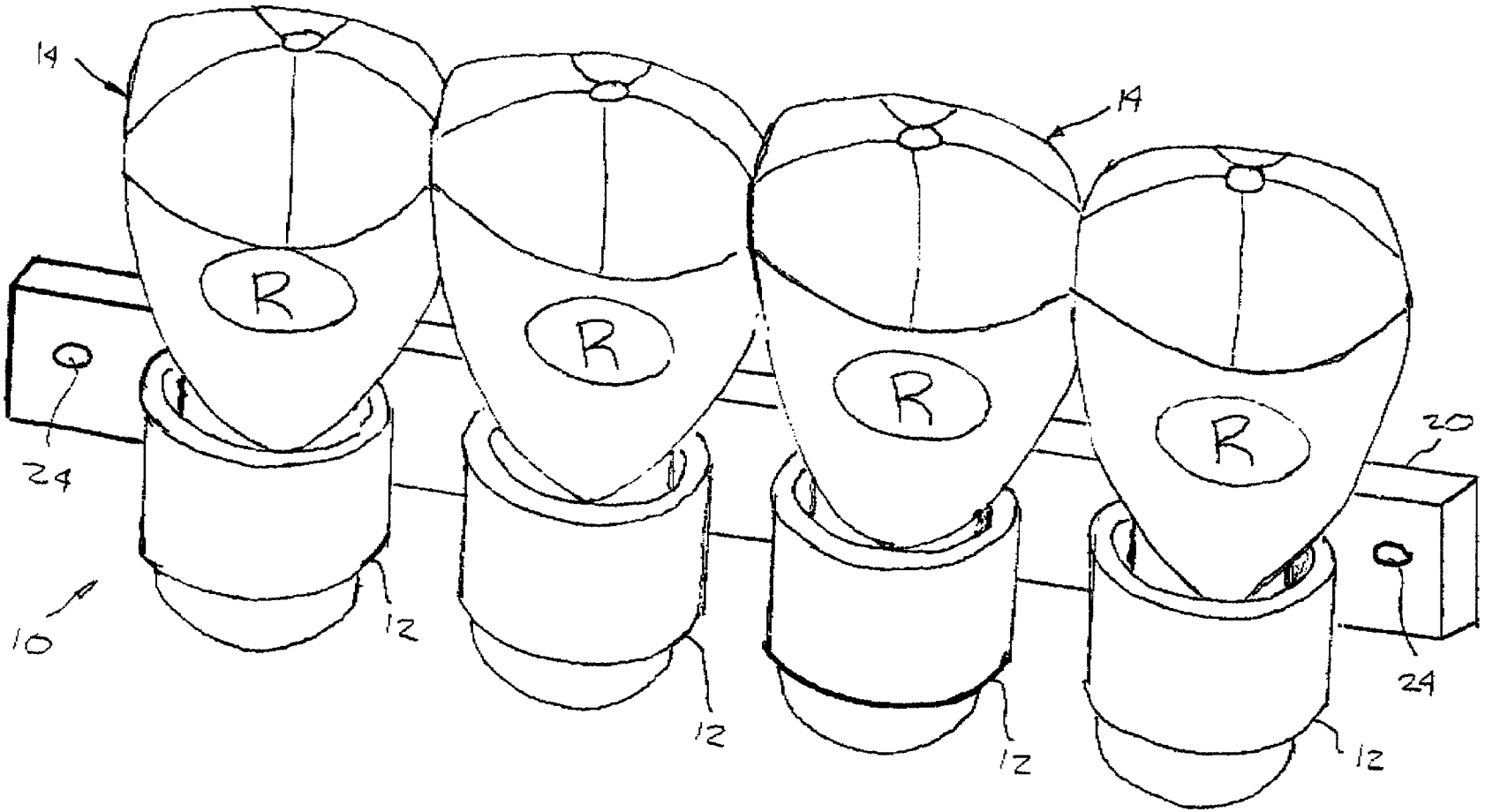
FIG. 1 is a perspective view of the hat storage and fashioning rack in accordance with a preferred embodiment of the invention.
Figure 2:
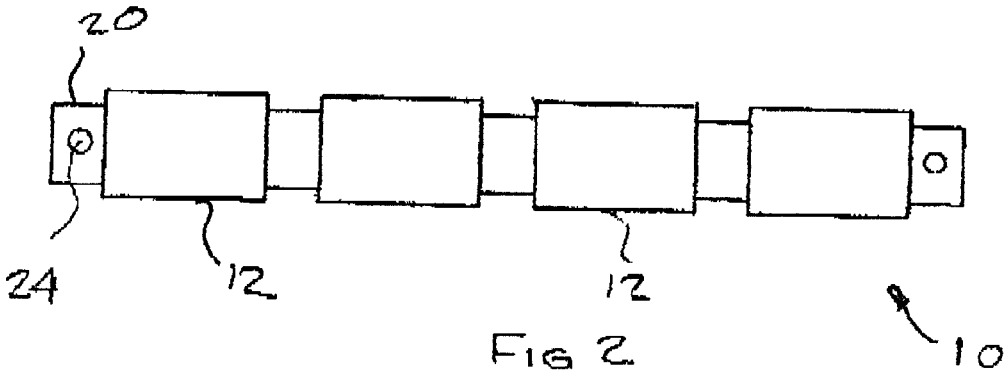
FIG. 2 is a front elevational view of the hat storage and fashioning rack.
Figure 3:
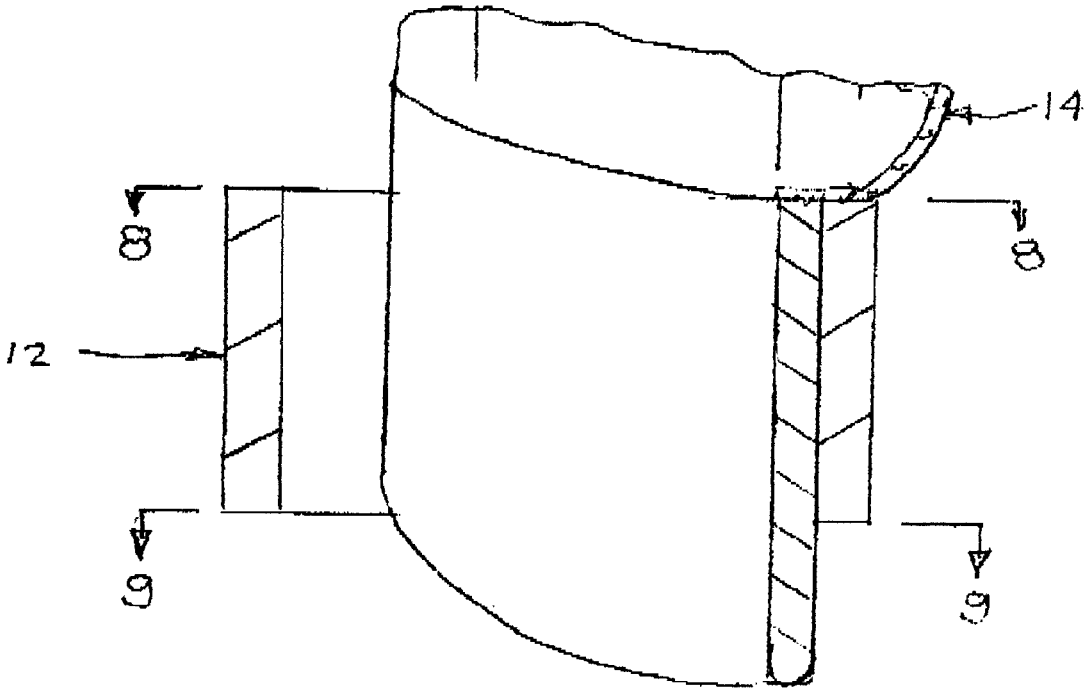
FIG. 3 is a vertical cross sectional view of a forming sleeve with a hat brim disposed therein.
Figure 5:
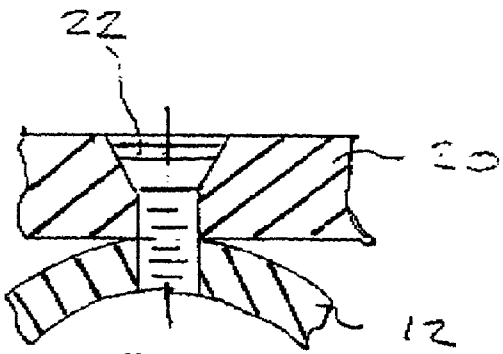
FIG. 5 is an enlarged fragmentary cross sectional view taken along line 5—5 in FIG. 4.
Figure 4:
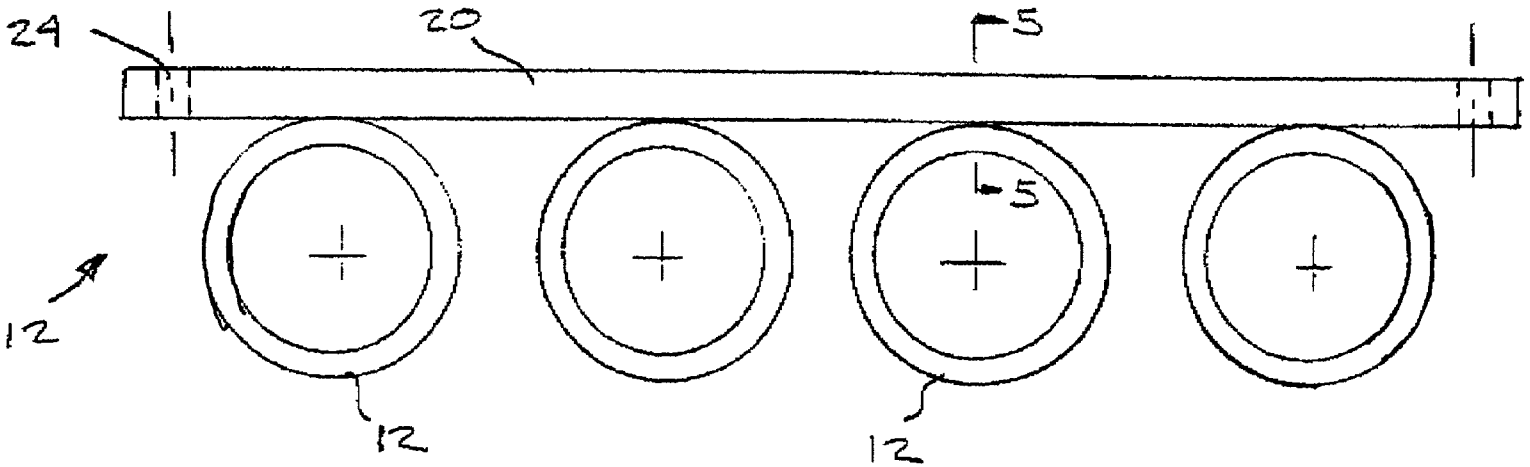
FIG. 4 is a top view of the hat storage unit.

Referring to the drawings for the purposes of illustrating a preferred embodiment of the invention and not for limiting same, FIG. 1 shows a hat storage and fashioning rack 10 representatively carrying, in a forming condition, on support sleeves 12 a plurality of hard billed hats 14, generally referred to as a baseball-type caps or hats. Four such sleeves 12 are illustrated, however, it will be appreciated that a greater of lesser number may be employed, each of which is adapted to support a hat of a similar type. The sleeves are aligned in a longitudinal series, but may also be disposed in a vertical arrangement or combinations thereof.

Referring additionally to FIGS. 2 through 5, the rack 10 comprises and elongated rectangular base 20 having the sleeves 12 attached thereto by fasteners 22 or other suitable means. Openings 24 are formed at the distal ends of the base outwardly of the adjacent sleeve for mounting the rack 10 by fasteners, not shown, on a generally vertical disposed mounting surface.

The sleeves 12 are cylindrical members of circular cross section and formed of a suitable material such as plastic pipe. The base 20 is rectangular in cross section and form of the same or otherwise suitable material such as wood or plastic substrate. The sleeves have a height slightly greater than the height of the base 20 and are horizontally symmetrically disposed with respect thereto.

Figure 6:
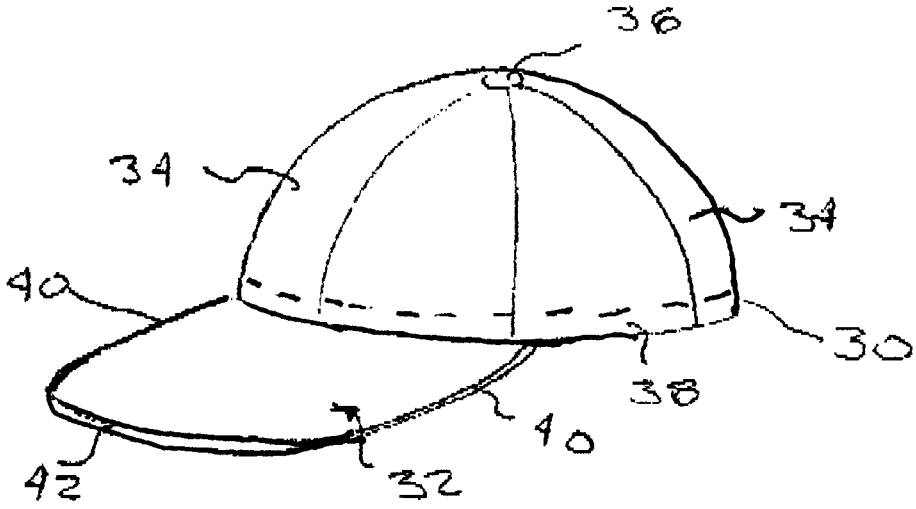
FIG. 6 is a perspective view of a cap with the brim in an unformed condition.
Figure 7:
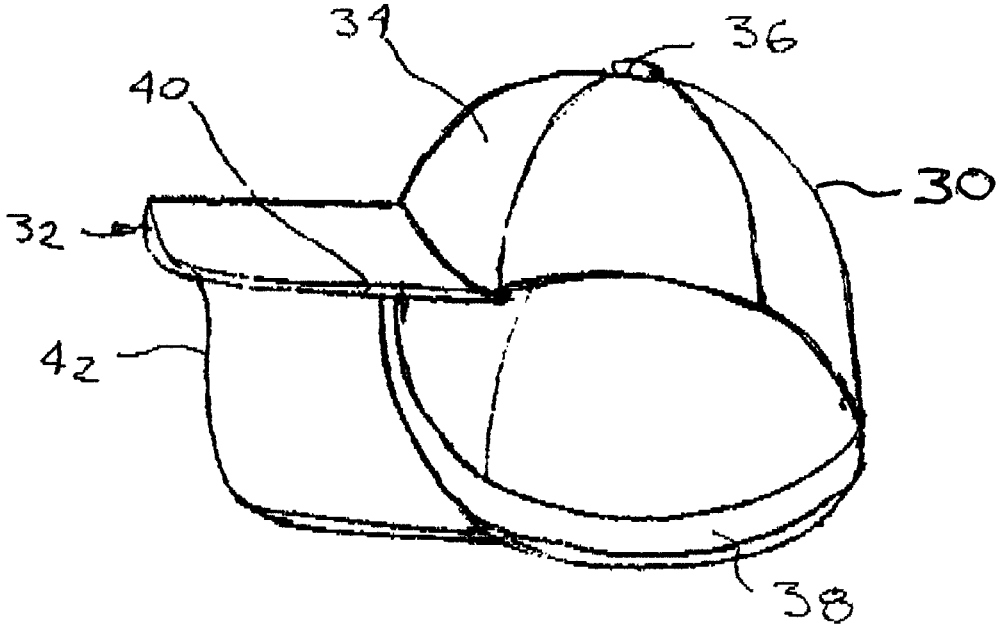
FIG. 7 is a perspective view of a cap with the brim in the formed condition.

As mentioned above, the sleeves 12 are adapted to support and progressively stylishly fashion the bill of a hat 14 of the type illustrated in FIG. 6. In conventional fashion, the hat 14 comprises a domed cap 30 and a frontally projecting bill or brim 32. The cap 30 is formed of a plurality of interconnected sewn panels 34 terminating upwardly with a cap button 36 and joined at the inner lower periphery thereof by an internal band 38. As purchased, the brim 32 is a generally planar composite and comprises a flexible formable inner layer with a fabric material stitched to the top and bottom surfaces thereof. The brim 32 has generally straight, laterally spaced sides 40 bounding an arcuate tip 42. The length of the brim from the top front adjacent the cap 30 to the tip 42 is generally in the range of about 2½ to 4 inches, typically 3 inches, and the sides 40 about 1 to 3 inches, typically about 1½ inches. The width of the brim 32 varies from about 5 to 8 inches, and typically about 7 inches. The interior substrate of the brim may be a synthetic or natural monolithic or composite material. The bill material is flexible and manually limitedly formable.

While some wearers will use the hat in the purchased condition, many for comfort, styling or personal reasons choose to impart a curvature to the brim contour. The brim may be manually conditioned. However unless gradually effected, excessive curvature may result in permanent deformation or cracking of the inner substrate. Further, unless effected along the length of the brim, localized deformations may result. Moreover, imparted curvatures tend to be lengthy processes and the internal memory of the substrate tends to restore a formed brim toward the original shape.

In order to overcome the foregoing problems, it is important to interrelate appropriately the conformal surfaces of the sleeve and the brim. First the inner wall of the sleeve should conform to the desired final curvature for the brim. Second, the curvature should not impose excessive stresses on the brim material that would cause abrupt permanent deformation. Too small a diameter can result in overlapping of the sides of the brim. Such a condition results in excessive curvature. Also, the overlapping causes abrasion during insertion and removal. The brim width should be about 40% to 85% of the inner circumference of the sleeve, preferably 60% to 75%, and in any event sufficient to permit the hat to be manually cupped and installed into the sleeve without cracking or otherwise prematurely deforming the brim substrate. Third, the sleeve should support the major portion of the brim inasmuch as unsupported portion tend to return to the purchased planar condition. At least a major portion of the brim length should be encompassed by the sleeve, generally about 50% to 80%, and preferably about 60% to 70%. Fourth, the arrangement should utilize the flexure strength of the brim, as supported in the sleeve, to provide a gradual progressive biasing as the brim material naturally relaxes in the storage condition. Compressive retention on both sides of the brim can result in overly stressing the brim and localized fracture of the material prior to achieving the desired conformation.

Figure 8:
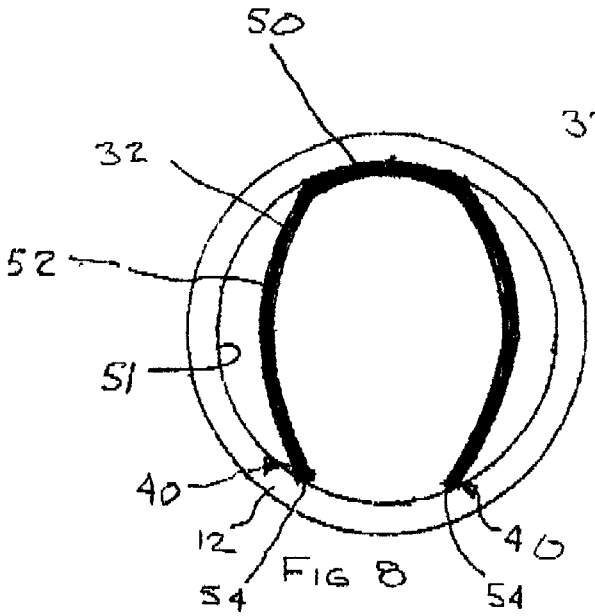
FIG. 8 is an enlarged cross sectional view taken along line 8—8 in FIG. 3 showing the base of the hat brim in the unformed condition.
Figure 9:
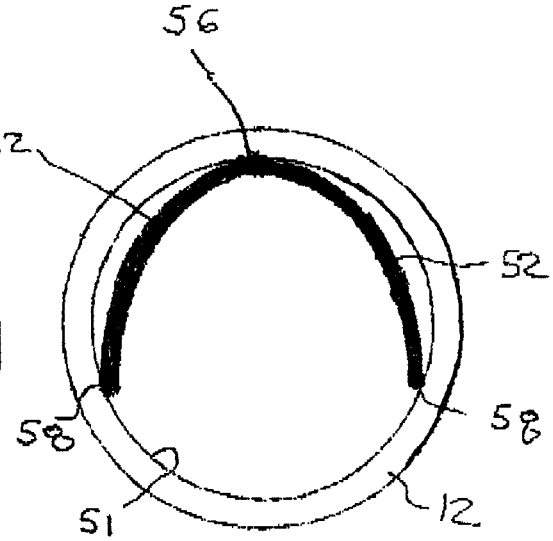
FIG. 9 is an enlarged cross sectional view taken along line 9—9 in FIG. 3 showing the front of the hat brim in the unformed condition.
Figure 10:
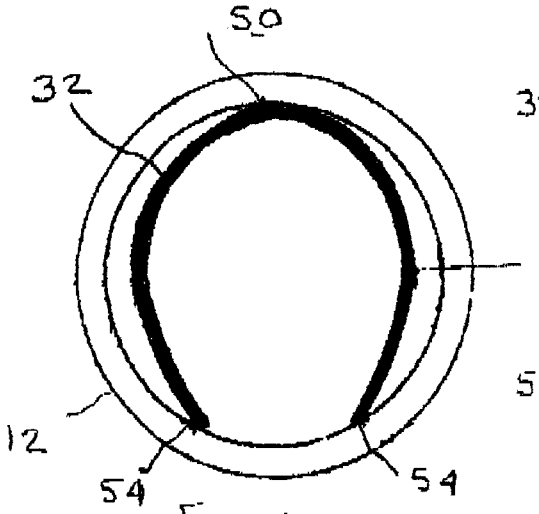
FIG. 10 is a view similar to FIG. 8 showing the base of the hat brim in a partially formed condition.
Figure 11:
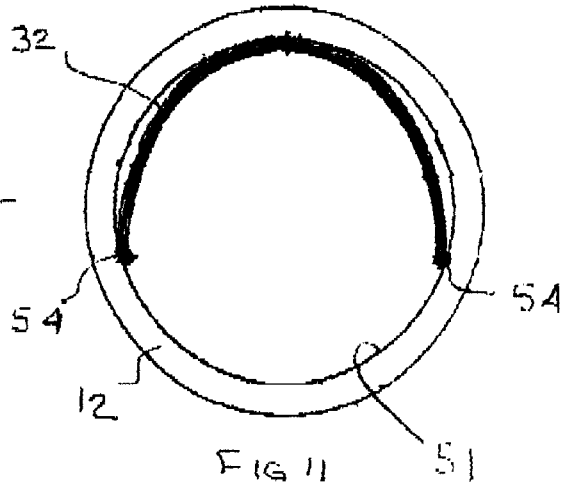
FIG. 11 is a view similar to FIG. 9 showing the front of the hat brim in a partially formed condition.

To this end, for a conventional hat brim, a sleeve diameter of 3 inches with a sleeve length of about 2 inches has been found to satisfy the above criteria for a conventional hat having a brim 7 inches wide and 2½ inches long. This size permits the hat brim to be lightly cupped, without over bending, and inserted into the sleeve without overlapping and without abrasively contacting the sleeve walls. This initial condition is depicted in FIGS. 8 and 9. Therein, the hat brim is longitudinally supported throughout the length of the sides 40 with only a portion of the tip 42 projecting therebelow. Such contact has been determined to result in overall uniform curvature without localized rebound of the type experienced with localized restraints. As shown in FIG. 8, the brim portion 50 adjacent the cap 30 conforms locally to the inner wall of the sleeve while the outer lateral portions 52 are biased inwardly with the edges 52 of the sides 40 making localized point contacts 54 with the inner surface 51. As shown in FIG. 9, at the bottom of the sleeve, the top 56 of the front 42 and the edges 58 of the front make localized contact with the sleeve 12. Accordingly, the flaps of the brim therebetween are spaced inwardly of the sleeve and the internal forces of the brim material will urge the sides of the brim toward conformity by material relaxation over time, as shown in FIGS. 10 and 11. In FIG. 10, it will be apparent that the sides have relaxed significantly inwardly into preliminary conformity with the sleeve at the cap area. As shown in FIG. 11, the frontal portion has also undergone substantial relaxation into conformity with the sleeve.

In tests conducted with the above described relationships, the brim was 7 inches wide, 3 inches long and had had sides 40 about 1½ inches. The brim, as illustrated in FIG. 8, had an initial 0.38 inch spacing from the inner wall of the sleeve. The edges 54 were located 0.19 inch from the base of the inner wall. At the bottom as shown in FIG. 9, the center of the sides were 0.25 inch from the inner wall and the edges 58 were 0.939 inch from the base of the inner wall. After 48 hours as shown in FIGS. 10 and 11 and as a result of material relaxation, the brim was spaced 0.25 inch from the inner wall of the sleeve and the tips 0.250 from the base. The front portion was 0.063 inch from the sleeve wall in almost total conformity with the sleeve. After removal of the hat from the rack at 5 days, the curvature remained without noticeable rebound.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed is:

1. In combination, a hat storage unit and a baseball hat with a planar forwardly projecting brim having a brim width and a brim length;

the unit comprising:

a base member; and a plurality of elongated tubular sleeve members connected to said base member, each sleeve member having an inner cylindrical wall engaging a major portion of said brim length and a circumferential length substantially greater than said brim width.

2. The hat storage unit as recited in claim 1 wherein said inner cylindrical wall of said sleeve member engages about 50% to 85% of said brim length.

3. The hat storage unit as recited in claim 2 wherein said brim width is about 40% to 85% of said circumferential length.

4. The hat storage unit as recited in claim 3 wherein said brim width is about 60% to 75% of said circumferential length.

5. The hat storage unit as recited in claim 1 wherein said inner cylindrical wall of said sleeve member engages about 60% to 75% of said brim length.

6. The hat storage unit as recited in claim 1 wherein said sleeve members are vertically aligned and horizontally spaced with respect to said base member.

7. The hat storage unit as recited in claim 1 wherein said base member includes means for facilitating mounting of said unit on a vertical support surface.

8. The hat storage unit as recited in claim 1 wherein said sleeve members are each formed of cylindrical piping.

9. The hat storage unit as recited in claim 8 wherein said sleeve members are formed of a plastic material.

10. A method of imparting a controlled curvature to a brim of a baseball-type hat comprising the steps of:

providing a sleeve member having a cylindrical inner surface having a circumference less than the width of said brim and a length at least equal to a major portion of the length of said brim;

forming said hat brim to a shape smaller than said inner surface;

inserting said brim while maintaining said forming into said sleeve member;

ceasing said forming and permitting said brim to expand into contact with said inner surface;

maintaining said contact for a sufficient time to allow said brim to relax into conformity with said inner surface and establish a desired curvature.

11. The method of imparting a controlled curvature as recited in claim 10 including the step of reinserting said brim into said sleeve member after said desired curvature is altered.

12. The method of imparting a controlled curvature as recited in claim 10 including the step of reinserting said brim into said sleeve member following each wearing of said hat.

* * * * *